US005261256A

United States Patent [19]

Ellenbecker et al.

[11] Patent Number: 5,261,256

[45] Date of Patent: * Nov. 16, 1993

[54] INSTANT FLEX RING GUARD

[76] Inventors: Dale N. Ellenbecker; Kathleen S. Ellenbecker, both of 1101 Vienna Ct., Grafton, Wis. 53024

[ * ] Notice: The portion of the term of this patent subsequent to Jul. 16, 2009 has been disclaimed.

[21] Appl. No.: 674,197

[22] Filed: Mar. 25, 1991

[51] Int. Cl.[5] ..... A44C 9/02

[52] U.S. Cl. ..... 63/15.6; 63/15.5

[58] Field of Search ..... 63/15, 15.5, 15.6, 15.65

[56] References Cited

U.S. PATENT DOCUMENTS

| | | | |
|---|---|---|---|
| 152,789 | 7/1874 | Annin | 63/15.6 |
| 3,214,939 | 11/1965 | Monahan | 63/15.6 |
| 3,557,571 | 1/1971 | De Santo | 63/15.6 |
| 3,835,664 | 9/1974 | Nesbit | 63/15.6 |
| 4,129,999 | 12/1978 | Shelton | 63/15.6 |
| 4,569,211 | 2/1986 | Lodrini | 63/15.6 |

FOREIGN PATENT DOCUMENTS

| | | | |
|---|---|---|---|
| 376142 | 7/1932 | United Kingdom | 63/15.6 |

OTHER PUBLICATIONS

Jay Norris Corp., *Parade*, Jul. 1978.

*Primary Examiner*—Renee S. Luebke
*Assistant Examiner*—F. Saether

[57] ABSTRACT

A ring guard or insert that is constructed of a soft flexible low durometer thermoplastic rubber that will lay flat and affix to the bottom inside of a finger ring shank by means of adhesion. This device after installation remains flexible that when a finger is inserted through the finger ring, the guard will flex out of the ring and then flex back into the finger ring when in position and will constantly exert pressure against the finger keeping the ring from spinning on the finger.

3 Claims, 4 Drawing Sheets

INSTANT FLEX RING GUARD

BACKGROUND AND SUMMARY OF THE INVENTION

Ring sizing methods such as attachments or guards are well known in the art in a variety of types. Conventionally, these devices are hard substances either consisting of metal or rigid plastic material. The metal ring guards are attached to finger ring shanks using a plier or a special tool to bend or wrap tabs around the shank or structural work which is required to attach the ring guards to the ring shank. The plastic ring guards wrap around the bottom of the finger ring shank. These prior art devices have inclined to be uncomfortable, cumbersome to install, and do not adapt well to inconsistent finger sizes.

Keeping the above in mind, it is a objective of this invention to provide an uncomplicated and economical method of sizing a finger ring smaller that will adapt well to different size fingers while sufficiently grasping the ring shank as to keep the ring from revolving around the finger of the wearer. In achieving the above objective, a soft flexible ring sizing attachment or insert made of a low durometer thermoplastic rubber is furnished. The invention is a flexible half round cord with tapered ends whereas the flat bottom side is designed to fit onto the flat inside bottom ring shank. An adhesive is placed on the bottom inside ring shank which holds the invention in place inside the finger ring.

When the invention is attached to the finger ring, the finger can be inserted through the ring in which the thermoplastic rubber will give way to the larger portions of the finger and then will succumb to the shape of the finger but stay attached to the ring without adjusting the ring insert. This ring insert because of its flexibility and soft material will give a comforting feel to the wearer of the ring. The invention consists of a low durometer thermoplastic rubber when worn on the finger increases the amount of friction with the finger keeping the ring from rotating around the finger.

Another object of the invention is to provide a design that creates a comfortable fit when the ring is being taken on or off.

Still another object is to provide a generally pleasant appearing structure in the ring and when the ring is on the finger.

A further object is to provide the wearer of the finger ring a method in which they can install the ring guard without the use of any special tool or knowledge. These objects, as well as other objects, of this invention will become readily apparent after reading the following description of the accompanying drawings.

DESCRIPTION OF THE PREFERRED EMBODIMENT

Figure 1:
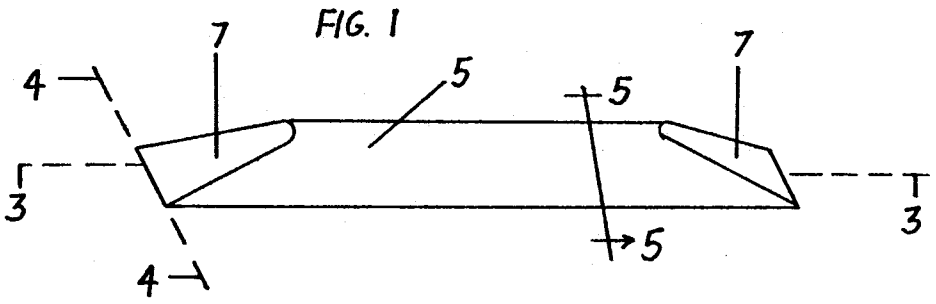
FIG. 1 is a perspective view of the invention.
Figure 2:
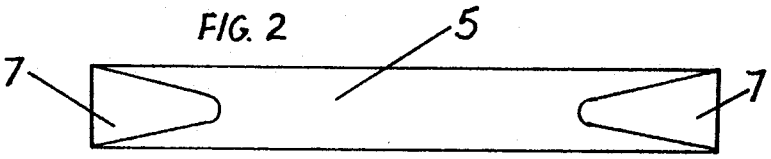
FIG. 2 is a top view profile of the invention.
Figure 3:
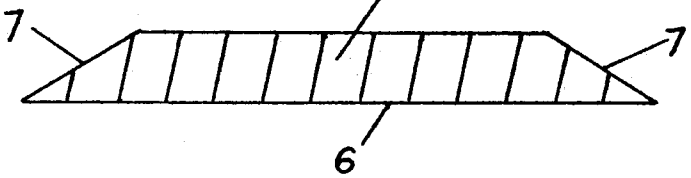
FIG. 3 is a transverse vertical profile of the invention taken on line 3—3 of FIG. 1.
Figure 4:
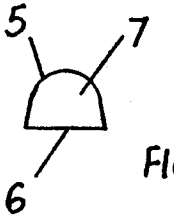
FIG. 4 is a longitudinal vertical profile taken on line 4—4 of FIG. 1.
Figure 9B:
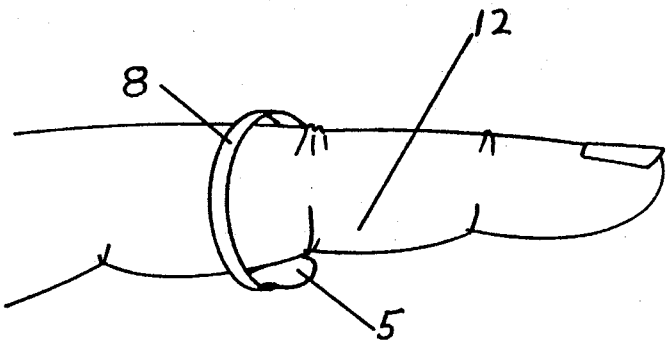
FIG. 9B is a prospective view of a finger and the invention as it is being inserted over the knuckle.
Figure 9C:
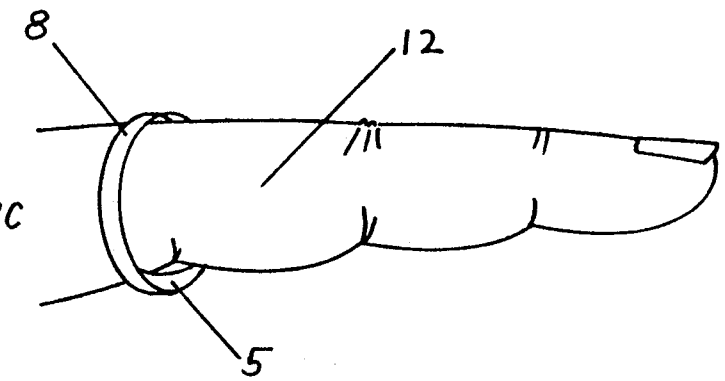
FIG. 9C is a prospective view of a finger and the invention as it remains in the correct position on the finger.
Figure 9A:
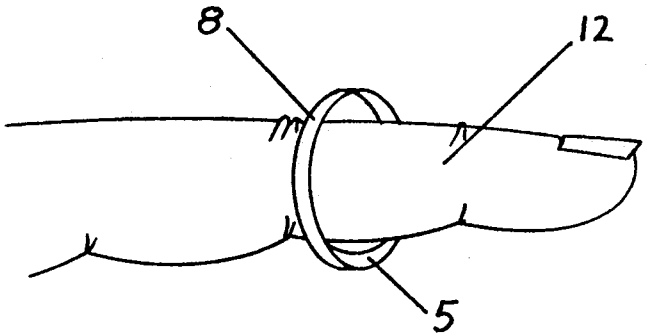
FIG. 9A is a prospective view of a finger and the invention as it is being inserted onto the finger.
Figure 10B:
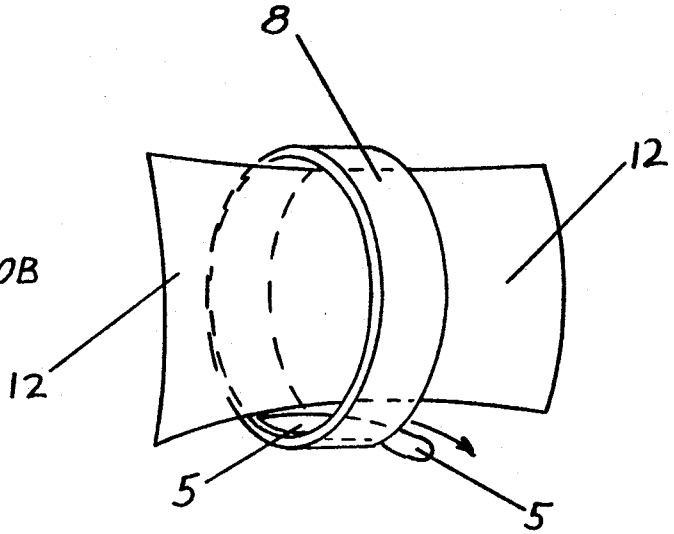
FIG. 10B is an enlarged prospective view of a finger and the invention as it is being inserted over the knuckle.
Figure 10C:
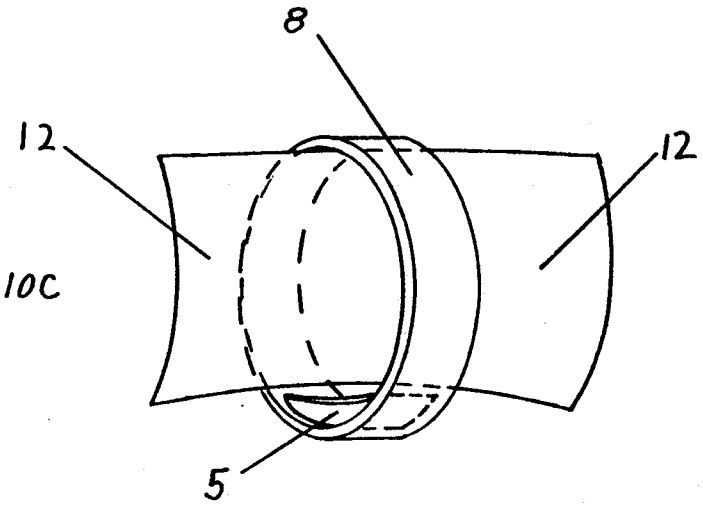
FIG. 10C is an enlarged prospective view of a finger and the invention as it remains in the correct position on the finger.
Figure 10A:
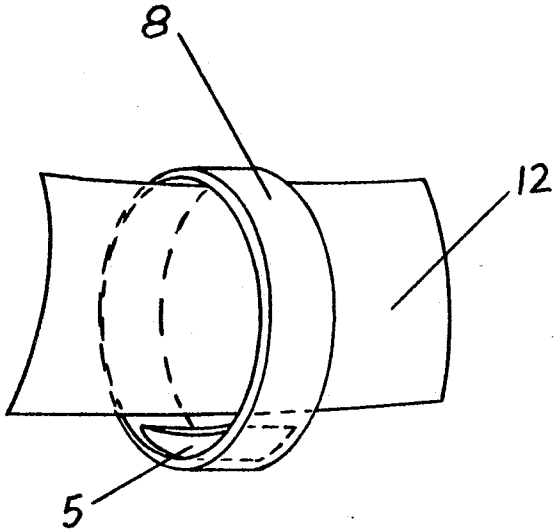
FIG. 10A is an enlarged prospective view of a finger and the invention as it is being inserted onto the finger.

Turning next to the drawings in detail whereas numerals designate parts and specifications, FIG. 1 shows the ring guard 5 in the original state. The ring guard is formed of a low durometer thermoplastic rubber which could be translucent. This invention when attached to the finger ring and then worn on the finger will remain unobtrusive because the invention is designed to lay flat onto the bottom inside ring shank shown in FIG. 9 whereas no modifications are needed to be made to the finger ring nor any part of the invention will be seen on the outside structure of the finger ring. The shape shown in FIGS. 1, 2, 3 and 6 in the original state is a flexible half round cord 5 in which the bottom side is flat 6 and the ends are tapered 7. The invention prior to application remains horizontal or straight and maintains a consistent thickness through its length and width also shown in FIGS. 1, 2, 3, and 6.

Figure 5:
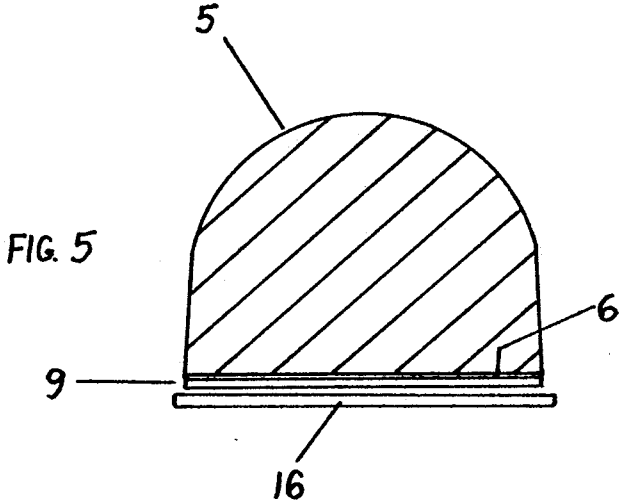
FIG. 5 is an enlarged transverse vertical profile taken on line 5—5 of FIG. 1 showing diminutive detail.

The invention shown in FIG. 5 is installed by means of adhesion which holds the flat bottom portion of the invention 6 onto the flat inside ring shank 10. The adhesive 9 is placed onto the flat bottom inside ring shank 10. The adhesive 9 keeps the ring guard secured inside the ring and continuously holds the flat bottom side of the ring guard 5 to the inside bottom portion of the ring 10. The adhesive may be covered by a thin protective material 16 which covers the entire bottom side of the invention 5 and keeps the adhesive moist until removed.

Figure 6:
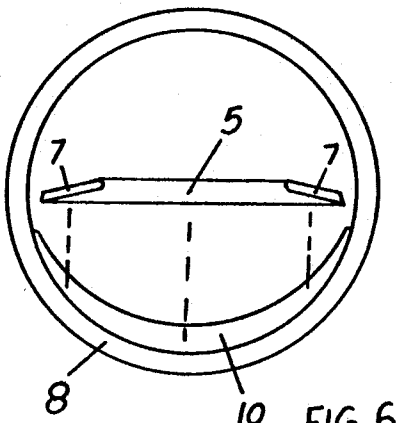
FIG. 6 is a prospective view of a finger ring and the invention both being shown in enlarged association relative to one another.
Figure 7:
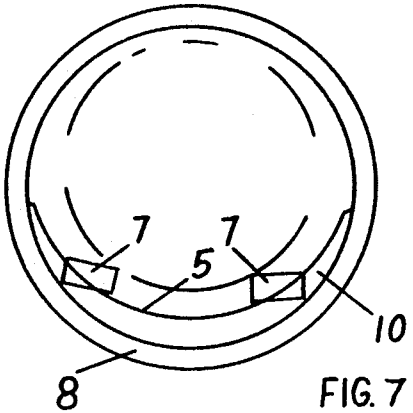
FIG. 7 is a prospective view of a finger ring and the invention similar to FIG. 6 but illustrating the invention after installation.
Figure 8:
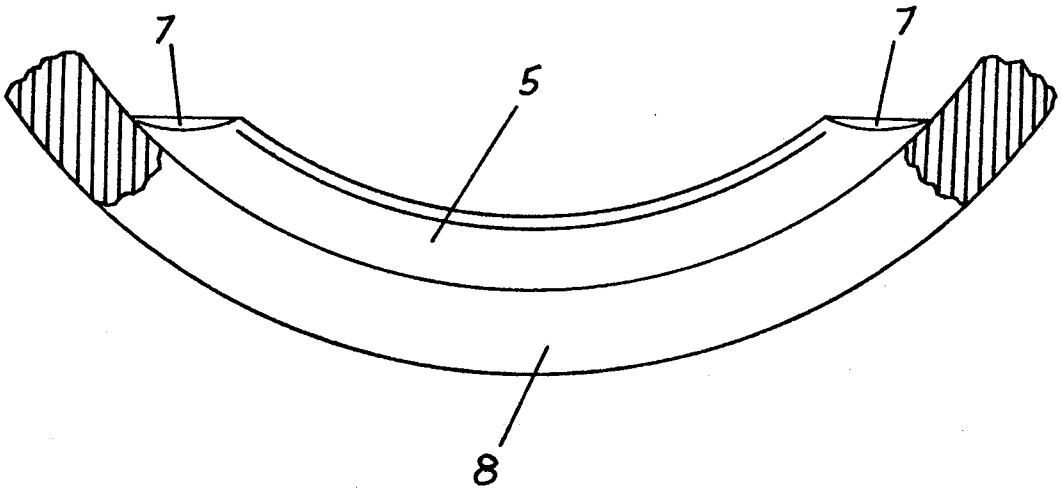
FIG. 8 is an enlarged transverse vertical profile of a lower finger ring shank and the invention after installation.

The invention 5 remains flat and horizontal shown in FIG. 6, before it is placed onto the flat inside bottom 10 of the finger ring shank 8. Installation is then accomplished by placing the invention flat side down 6 onto the flat inside bottom surface 10 of the ring shank 8. Once the invention is lined up in the center of the flat inside bottom of the ring shank, pressure is to be applied to the top of the invention. Immediately the adhesive will aggressively fasten to the bottom of the ring shank 8 and onto the flat bottom side 6 of the invention 5 holding the ring guard 5 in place shown in FIG. 7.

The invention after installation shown in FIGS. 9A, 9B, 9C, 10A, 10B, and 10C is unique because when the finger ring is inserted onto the finger 12, the finger ring will pass over larger portions of the finger 12. The top portion of the ring guard 5 will flex and stretch out of the ring while the adhesive holds the flat bottom side of the invention 5 to the bottom inside ring shank 10. This allows for a finger ring 8 to pass over the knuckle and once into position 12 on the finger the ring guard 5 will flex back into the ring and conform to the shape of the finger shown in FIGS. 9C and 10C. The ability of the ring guard 5 to flex in and out of the ring and yet still be comfortable and inconspicuous is possible because of the half round design 5 shown in FIGS. 1, 2, 3, and 4, the design in which the invention lays flat onto the inside bottom ring shank, the soft flexible thermoplastic rubber, and the adhesive 9 shown in FIG. 5 which holds the ring guard in place.

As a result from the facts presented above, the invention being a sizing device or insert is more comfortable when worn and when taken on or off of the finger, more competent in keeping the finger ring from rotating on the finger, more pleasantly appearing, and uncomplicated to install than the prior art devices or inserts for this purpose.

It is to be understood that the shape of the invention described above is given as a favorable example of the like, in that several alterations in the size and shape may be employed without deviating from the heart of the invention or focus of the subjoined claims.

We claim:

1. A ring sizing device for use in combination with a finger ring comprising a generally straight elongated member with a half round cord upper portion having tapered ends and a flat bottom portion wherein the flat bottom portion is secured by an adhesive to an inside portion of the ring, said device is made of a low durometer thermoplastic rubber which flexes to conform to the inside of the ring, once secured the half round cord portion will flex out of the ring when it passes a larger portion of a finger and then will flex back and conform to the shape of the finger.

2. A ring sizing device as in claim 1, wherein said low durometer thermoplastic rubber is translucent.

3. A ring sizing device as in claim 1, wherein said adhesive is protected by a thin covering prior to securement to the ring, and, make drawing corrections as shown in red on the attached sheets.

* * * * *